United States Patent [19]

Baker

[11] 3,958,579

[45] May 25, 1976

[54] CIGARETTE FILTER

[75] Inventor: Jack C. Baker, Atlanta, Ga.

[73] Assignee: Baker-Alpha Corporation, Atlanta, Ga.

[22] Filed: Oct. 26, 1973

[21] Appl. No.: 409,900

Related U.S. Application Data

[62] Division of Ser. No. 286,851, Sept. 7, 1972, abandoned.

[52] U.S. Cl. ..... 131/10.5; 131/261 B; 131/216

[51] Int. Cl.[2] ..... A24B 15/02; A24B 15/27

[58] Field of Search ..... 131/10.5, 261 B, 210, 131/213, 218, 199, 10.7, 10.9, 216

[56] References Cited

UNITED STATES PATENTS

| | | | |
|---|---|---|---|
| 261,169 | 7/1882 | Munson | 131/10.5 |
| 864,076 | 8/1907 | Buse | 131/199 |
| 973,870 | 10/1910 | Matson | 131/210 X |
| 1,877,925 | 9/1932 | Martin | 131/218 |
| 3,552,399 | 1/1971 | Andreas | 131/261 B |
| 3,626,952 | 12/1971 | Mysels | 131/10.5 |
| 3,631,864 | 1/1972 | Beard | 131/210 X |
| 3,631,867 | 1/1972 | Beard | 131/261 B |
| 3,651,819 | 3/1972 | Beard | 131/210 X |
| 3,667,481 | 6/1972 | Thomas | 131/261 B |

*Primary Examiner*—Robert W. Michell
*Assistant Examiner*—V. Millin
*Attorney, Agent, or Firm*—Newton, Hopkins & Ormsby

[57] ABSTRACT

A filtered cigarette including a forward portion, a strainer and a filter, in which the filter is of molded plastic, having one or a plurality of surfaces provided with interconnected channels which provide long and tortuous paths through which the air-smoke mixture passes.

In one embodiment, the passageway of the filter is around the periphery of a hollow cylindrical core, covered by paper. This passageway comprises a plurality of circumferentially disposed axially spaced grooves interconnected by axially extending connector channels. Islands or abutments at the discharge ends of certain air-smoke channels abruptly change the direction of flow of air-smoke mixture and separate it into separate streams which eventually are recombined.

Another embodiment includes a flat wafer core inserted into a cylindrical housing which covers the transverse and longitudinal channels formed in both sides of the wafer. Holes or aperture interconnect certain channels of one side of the wafer with certain channels of the opposite side.

Modifications of the second embodiment include angularly disposed channels to create turbulence and ragged passageway walls to retain the solids in the smoke.

Still another embodiment includes a plurality of stacked or laminated wafers forming a composite filter, the passageways of one wafer thereof communicating with the passageways of the next wafer, etc.

7 Claims, 22 Drawing Figures

CIGARETTE FILTER

REFERENCE TO RELATED APPLICATION

This is a division of application Ser. No. 286,851 filed Sept. 7, 1972 now abandoned.

BRIEF SUMMARY OF THE INVENTION

This invention relates to a filtered cigarette and is more particularly concerned with a low cost plastic filter for incorporation as a composite part into a cigarette.

In the past, filtered cigarettes have received quite widespread acceptance. This is particularly true in recent years where certain diseases have been attributed to or associated with the inhalation of cigarette smoke containing high amounts of tar and nicotine. Thus a concerted effort has been directed toward obtaining a filter which will remove the harmful constituents of cigarette smoke without detracting from the flavor and "draw" of the cigarette.

Briefly described, the present invention, which attempts to achieve the desired results of removing tar and nicotine from the smoke, while retaining the flavor and ease of the draw, includes a cigarette provided with a molded plastic filter and a conventional tobacco front portion.

The outer surface of the filter core has interconnected outwardly open channels or grooves which provide a tortuous passageway for the smoke and air from its forward end to its rear end. Circumferentially disposed paper or a housing covers the open channels so as to define a passageway in which the velocity and direction of the smoke are repeatedly, abruptly changed to deposit the solids or particulates material on the walls defining these channels. The filter, being composite part of a filtered cigarette, is thrown away with the butt of the cigarette after it has been smoked.

The inventive concept of the present invention is depicted in several embodiments illustrated in the accompanying drawings, the first embodiment showing a hollow cylindrical plastic core which is provided with circumferential U-shaped channels forming a passageway from the intake part to exit parts. Certain of these channels are interrupted by protrusions and islands which direct the smoke passing along the channels, in different directions. The inlet part for the filter is an axial channel, the discharge end of which discharges into a cavity provided with a central island so that the flow of the smoke is divided and then brought back together after the changing both its directon and velocity. Thence, the tortuous path leads around certain abutments and through irregular paths into the first of the axially spaced peripheral channels. The smoke then travels through an axial channel into a second peripheral channel and is thereafter directed by the circumferentially space discharge ports or channels exteriorly of the filter.

A gauze or grid mixture type strainer, disposed between the forward portion of the cigarette and the filter, separates the tobacco from the filter and a plug in one end of the hollow tubular filter prevents the flow of the smoke through the central portion of the filter, so that its sole path is through the peripheral passageway.

In the second embodiment, a single rectangular wafer, having flat opposed parallel surfaces, forms the filter. This wafer is provided with outwardly open passageways on both sides, the channels of one side communicating with the channels of the opposite side through holes passing through the wafer. The wafer is received within a holder or housing which forms the cover for the passageways and appropriate openings are provided for the ingress and egress of the smoke into and out of the filter.

Modifications of the second embodiment include converging angularly disposed ports for ingress, as well as serrations for capturing the particulate material and for creating a tortuous path for the smoke.

The third embodiment depicted in the drawings is in the form of a plurality of wafers similar to the wafer depicted in the second embodiment. These wafers are hingedly joined together so as to fold into a single composite which is inserted into the holder. In this way, a plurality of passageways from one wafer to the next, to the next is provided.

Accordingly, it is an object to the present invention to provide a cigarette filter which is inexpensive to manufacture, durable in structure and efficient in operation.

Another object to the present invention is to provide a cigarette filter which, while not appreciably, increasing the pressure differential necessary to draw smoke through the filter, provides a highly effective filter for the separation of the liquids and solids from the smoke.

Another object to the present invention is to provide a filter which will cool the smoke as it is filtered.

Another object to the present invention is to provide a cigarette filter which will aid in reacting the carbon monoxide to carbon dioxide during the travel of the smoke and air through the cigarette.

Other object, features and advantages of the present invention will become apparent from the following description when taken in conjunction with the accompanying drawing.

DETAILED DESCRIPTION OF THE INVENTION

Figure 1:
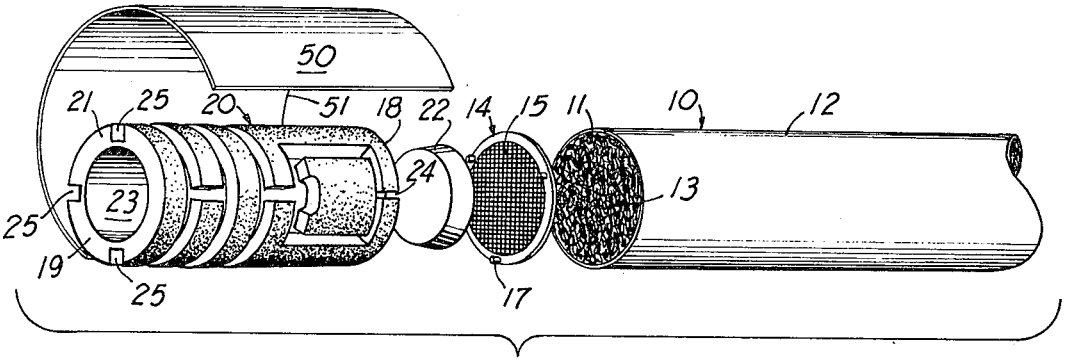
FIG. 1 is an exploded view of one embodiment of a filtered cigarette constructed in accordance with the present invention.
Figure 2:
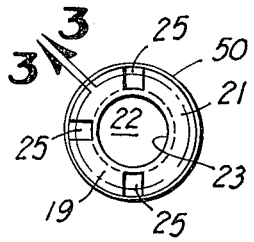
FIG. 2 is an end elevational view of the filtered cigarette depicted in FIG. 1.

Referring now in detail to the embodiment chosen for the purpose of illustrating the present invention, numeral 10 denotes generally a conventional front portion of the filtered cigarette depicted in FIG. 1. This front portion 10 contains the tobacco 11 confined by the tubular hollow cylindrical cigarette paper cover 12. It is well understood the distal end of the front portion 10 is lighted when the cigarette is being smoked and that a mixture of smoke and air passes through the shredded tobacco 11 and out the proximal end 13 of portion 10. At this stage, the smoke and air mixture (called smoke hereinafter) is unfiltered, except insofar as the tobacco 11 acts as a filter.

Abutting the proximal end 13 is a disc shaped grid strainer 14, the function of which is to prevent the tobacco 11 from passing into or sealing off the entrance or in the intake part of the filter 20 to be described hereinafter. This grid 14 is circular in shape so as to conform to the diameter of the cigarette. It comprises a very fine mesh or gauze like plastic interior 15 and a rim 16 from which protrude circumferentially spaced fingers 17. The grid 14 can be injection molded, if desired.

In FIG. 1, it is seen that the filter, denoted generally by numeral 20, includes a hollow cylindrical body or core 21 and a tapered, frusto-conical plug 22 for the distal end 18 to close the hollow portion of the core 20. The plug 22 is disposed between the core 21 and the grid 14 and blocks any traveled of fluids through the interior passageway 23 of core 21. Thus, all smoke which will be drawn through the cigarette must travel along the periphery of the core 21.

Figure 3:
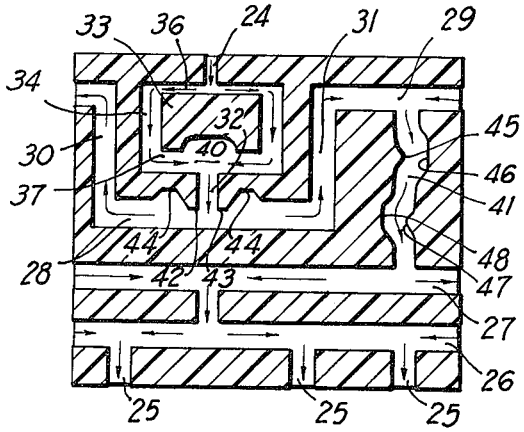
FIG. 3 is a rolled-out plan veiw of the periphery of the filter depicted in FIGS. 1 and 2, the rolled-out view being taken along line 3—3 in FIG. 2.

As best seen in FIG. 3, only a single entrance or intake port or channel 24 is provided in the core 21 at the periphery of distal core 18. A plurality of discharge channels or ports 25 are provided at the periphery of the proximal end 19 of core 20. Thus, the smoke entering the channel 24 follows a tortuous peripheral passageway and emerges through these channels 25.

In more detail, the outer periphery of the core 21 is provided with a plurality of axially spaced circumferentially disposed peripheral channels 26 and 27 adjacent proximal end 19. The grooves or channels 26 and 27 extend entend entirely around and are provided in the core 21 so that they are continuous U-shaped outwardly open grooves or rings. A single channel 28A, which extends in an axial direction, provides communication between periphery channels 26 and 27. The discharge ports or channels 25 communicate circumferentially at spaced intervals with channel 26.

Spaced forwardly of the major circumferential channels 26 and 27 is a minor peripheral channel 28 which covers approximately 180 degrees of the surface of core 21 and a second peripheral channel 29 which is off-set forwardly of channel 28 covering the other 180° of the body 21. Axial, diametrically opposed, channels 30 and 31 extend from the ends of the channels 28 and to the ends of channel 29 so as to provide communication therebetween. For additional turbulance, an irregularly shaped serpentine channel 41 is provided generally in an axial direction from the central part of the channel 29 to the channel 37. It will be understood that the channel 28A is in axial alignment with the channels 32 and 24 while the channels 41 and 25 are offset or diametrically spaced therefrom to enhance the length of travel of the smoke passing through the maze defined by these U-shaped channels. The zig-zagged path of channel 41 will provide a protuberance 45 opposite a concaved recess 46 and a protuberance 47 opposite a recess 48 so as to create a turbulance, eddy currents, and generally a depositing of the solids, due to centrifugal force.

Adjacent the discharge end of the channel 32, there are axially extending protrusions 42 and 43 which tend to restrict the area of the central portion of laterally extending channel 28 and thereby increase the velocity of the smoke, as the smoke abruptly changes direction from a radial path to a pair of lateral diverging paths. Laterally spaced from the channel 32 are a pair of opposed recesses 44 which are outwardly adjacent their corresponding protrusions 42 and 43 so that immediately after passing the restricted zones, defined by protrusions 42 and 43, the smoke is introduced into these larger areas so that turbulance is imparted to the smoke. The changing of direction of the smoke, its acceleration and its turbulance, all contribute to the deposiging by centrifugal force of the particulate material or solids and liquids from the smoke onto the walls defining the various channels.

In the exploded view shown in FIG. 1, the filter 20 is encompassed by a sheet of paper 50, the leading edge 51 of which overlaps the paper 12. Thus, the paper 50 forms a cover for the various channels, and passageways hereinabove described. The paper 50 also maintains plug 22 in place in the distal end 18 of the core 21, as well as maintaining, in place, the rigid 14.

When a person "puffs" on the cigarette, smoke passes from the lighted end through the confines of the paper 12 and through the grid 14. Thence, the smoke passes through the channel 24, and is divided into two approximately equal, streams of smoke which pass laterally outwardly on opposite sides of the inner end of the channel 24 via the channel 36. At this point, a substantial amount of solids and liquids will be deposited along the leading edge 49 of the island 33. This is due to the centrifugal force, as the smoke abruptly changes direction of travel from an axial direction to a lateral or radial direction.

The smoke encounters a second 90° bend in passing from the channel 36 into the channels 34 and 35, respectively. Still another 90° bend is encountered by the separated streams in moving from the channels 34 and 35 into the channel 37. At this point, the two streams of smoke are directed toward each other and toward a wider area in the central portion of the channel 37, as defined by the recess 40. This causes a co-mingling and a turbulance of the two streams as they are recombined and may tend to cause a reaction between the carbon monoxide of the smoke and the oxygen of the mixed air so that additional carbon dioxide is created with a minimizing of the carbon monoxide.

Thence, the recombined stream of smoke passes outwardly through the channel 32 and is again divided into two streams, being directed radially outwardly on both sides of the channel 32 in the channel 28. The two streams are accelerated by the restriction created by the protrusions 42 and 43 and additional turbulance is created by the arrangement of the recesses 44. The abrupt change and increase in velocity will tend to deposit still additional tar or solid matter and liquid on the walls defining channel 28. The two streams of smoke are fed outwardly of each other along minor peripheral channel 28 and thence in parallel paths in an axial direction toward the distal end 18 of the filter along the channels 30 and 31. At the ends of the channels 30 and 31, the two paths of smoke are again directed in radial directions along the minor peripheral channel 29 so as to recombine at the mouth of the channel 41. The smoke then travels down the channel 41 in a tortuous zig-zagging path into the major peripheral channel 27 where the smoke again separates and is directed radially, being brought together at the axial channel 28A where it is directed longitudinally outwardly of the cigarette into the second major peripheral channel 26. In channel 26, the step of separation is repeated and at this time, after passing in a radial direction in two paths, the smoke is passed outwardly of the filter through the three discharge ports or channels 25.

The maze of passageways leading from the intake port or channel 24 to the discharge ports or channels 25 enable the smoke to travel many times the distance from one end of the filter core 21 to the other end thereof. This elongated path surrounded as it is on three sides by the plastic material of core 21 which may, if desired, be electrostatic and is believed to accomplish seven major functions. The smoke particle passing at relatively high velocity and impinging upon the walls of the various passageways or channels will perhaps create an electrostatic charge which will tend to cause the solids to be retained electrostatically by the plastic. Polyethylene, being relatively inexpensive and being electrostatic in nature, is a suitable plastic to be utilized for forming the core 21. The second function of this tortuous rambling path, through which the smoke must pass, is that of cooling the smoke so that hot fumes do not enter the mouth. The paper cover 50, which forms the fourth side closing the tops of all channels, permits rapid conduction of heat from the smoke.

Since the various channels are along the periphery of the core 21, all have open tops and are essentially unrestricted. Thus, the cigarette is easy to draw and requires little pressure differential to impart considerable velocity to the smoke passing through the maze. Also, the fact that only a thin layer or sheet of paper 50 separates the smoke from the ambient air, provides ample area for the transfer of heat away from the smoke. Also, the lips of the person smoking will be contact with the paper sheet 50 and hence serve as an additional conductor of heat away from the smoke.

SECOND EMBODIMENT

Referring specifically to FIGS. 4–8 which depict the second embodiment of the present invention, it will be noted that, as in the preceding embodiment, there is a tobacco portion 10 of a cigarette which comprises the tobacco 111 encased in a paper sheet 112. Adjacent the proximal end 113 of the forward portion 110 is a grid 114 which is identical in structure to the grid 14.

The filter, denotes generally by 120, is disposed rearwardly of the grid 14 and comprises a housing or casing 121 and a core 122. In the present embodiment, the core 122 is a flat rectangular plastic wafer which is received in an appropriate rectangular hole 123 in the central hub 125 of casing 121.

In more detail, the casing 121 is a unitary molded body, cylindrical in overall shape and comprising a plurality of equally spaced diametrically opposed fins 124, disposed in axially spaced, parallel relationship to each other and extending from opposite sides of the central hub 125.

The hole 123 which receives the wafer 122 extends throughout the hub 125 and is of uniform generally rectangular shape throughout its length so as to conform to the general rectangular shape of the wafer 122.

Figure 6:
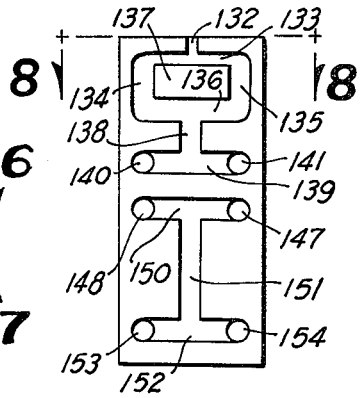
FIG. 6 is a cross-sectional view taken substantially along line 6—6 in FIG. 5.
Figure 7:
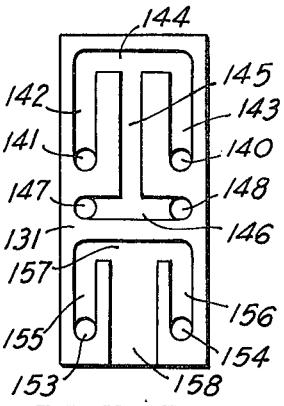
FIG. 7 is a cross-sectional view taken substantially along line 7—7 in FIG. 5.
Figure 8:
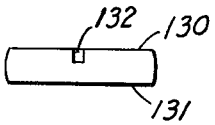
FIG. 8 is a cross-sectional view taken substantially along line 8—8 in FIG. 6.

As best seen in FIGS. 6, 7 and 8, the wafer 122 has a pair of flat surfaces 130 and 131 which are parallel to each other. Both surfaces 130, 131 are recessed so as to provide the channels or passageways through which the smoke is drawn from its forward or distal end 100 to the proximal end 101 and into the mouth of the smoker. One the side of wafer 122 of surface 130, there is provided an entrance channel 132 which leads from end 100 to an intermediate portion of a traverse channel 133, the channel or port 132 being at approximately the mid-portion of the transverse or laterally extending channel 133. The ends of the channel 133 communicate with a pair of axially extending channels 134 and 135 which lead to the ends of a second transverse channel 136 which is disposed parallel to the spaced from the channel 132 so as to surround, with the channels 133, 134 and 135, a central island 137.

In alignment with the entrance channel or port 132 is an intermediate channel 138 which communicates with the central portion of a transverse channel 139, the channel 139 being disposed parallel to and spaced from the channels 133 and 136. The ends of channel 139 communicate respectively with transverse parallel holes 140 and 141 which, in turn, communicate with the channels depicted in FIG. 7, i.e., the channels in surface 131 of the wafer 122.

In more detail, the holes 140, 141 communicate respectively with the rear ends of a pair of parallel axially extending channels 142 and 143 which communicate with the ends of a laterally extending channel 144 connecting to the forward ends of the two channels together. The central portion of the channel 144 communicates with the forward end of an axial channel 145 which leads to the central portion of a transverse channel 146 rearwardly of the holes 140, 141. At the ends of the transverse channel 146 are a pair of holes 147 and 148, respectively which are disposed parallel to the holes 140 and 141, the ends of these holes 147 and 148 terminating at the ends of a transverse channel 150 in the surface 130 of the wafer 122. The mid-portion of the transverse channel 150 communicates with one end of an axially extending channel 151 which terminates in the central portion of a transverse channel 152 which is parallel to the transverse channel 150. At the ends of the channel 152 are a pair of holes 153 and 154 which are disposed parallel to the aforesaid holes 140, 141, 147 and 148 and lead to the ends of a pair of spaced parallel axially extending channels 155 and 156 which extend forwardly from the holes 153 and 154. The ends of the channels 155 and 156 communicate with ends of the transverse channel 157, the central portion of which is connected to a discharge channel or port 158 disposed between the channels 155 and 156, extending parallel thereto.

Figure 4:
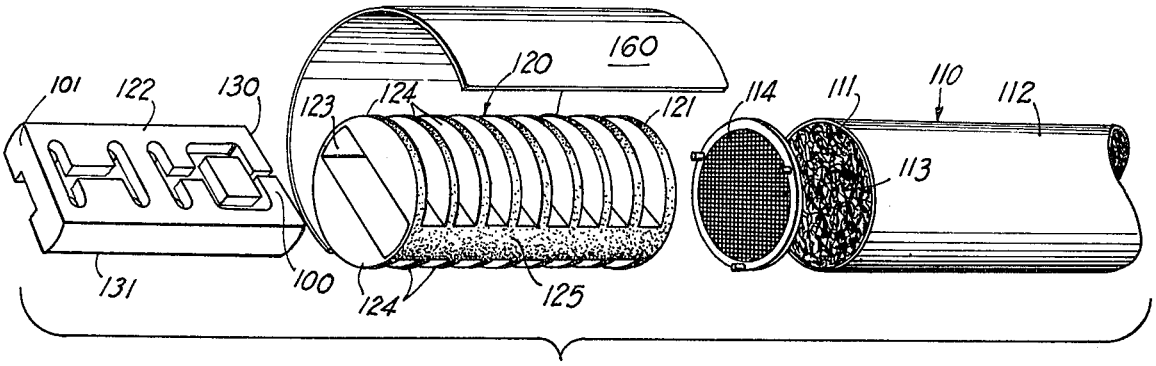
FIG. 4 is a view similar to FIG. 1 but showing a second embodiment of the present invention.

When the wafer 122 is inserted into the opening 123, the inner surfaces of hub 125 defining this opening 123 close and form the outer surfaces of the channels depicted in FIGS. 4 and 7. Also, a cover sheet 160 wraps around the body 121, overlapping a portion of the paper of the sheaf sheet 112 so as to complete the cigarette.

Upon a person drawing on or sucking on the cigarette thus provided, the smoke passes inwardly through the sheaf 112 and thence through the grid 114 and into the filter 120. In more detail, the smoke after passing through the grid 114 passes through channel 132, at which point it is separated into two paths which extend laterally from each other so that a substantial amount of the tars or other solid material is deposited on the front surface of the island 137 as a result of centrifugal force. Thence, the divided streams of smoke pass through the channels 134 and 135 and recombine after passing inwardly along the channel 136. Upon being recombined, the smoke passes down channel 138 and into the channel 141 where it is again divided into two separate streams and passes through the holes 140 and 141. Thence, the two streams pass respectively along the channels 142 and 143, from the holes 140 and 141 to the transverse channel 144 where the smoke passes inwardly and is recombined to pass axially along channel 145. Thence the smoke is again divided and passes laterally outwardly along channel 146 to the holes 147 and 148, respectively. From these holes, the smoke passes to channel 150 and moves inwardly toward each other to be recombined and be directed along the channel 151. The smoke is then discharged into the transverse channel 152 which passes the smoke through the holes 152 and 154 and into the channels 156 and 157 where the smoke again passes forwardly into the transverse channel 157 being received at the forward end of the channel 158. Thereafter, the smoke is discharged down the channel 158 out of the proximal end 101 of the filter.

With each abrupt change in direction of travel of the smoke, there is a tendency to throw out the accumulated tars and solids from the smoke, and due to the solubility of the nicotine to absorb the nicotine which is retained within the filter. Again it should be mentioned that the filter can be made of an electrostatic plastic so that there is attraction between the walls of the filter and the particle entrained in the smoke.

Furthermore, since the path, through which the smoke travels in the filters herein described, can be made as long as desired, within practical limits, it may be found desirable to provide sufficient volume within the paths so that the smoke, taken in during a normal puff, will only be that smoke which is previously been retained in the filter for a sufficient length of time to precipitate out the entrained solids. Preferably, however, the path of travel of the smoke should be from approximately 2½ inches to approximately 4½ inches in the embodiment depicted in FIG. 1. With such an arrangement, there only a 5 percent pressure differential in order to draw the smoke through the filter since all channels are well above capillary size.

Figure 9:
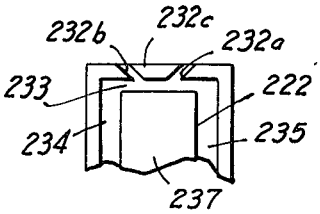
FIG. 9 is a schematic plan view of a portion of a wafer of still another form of filter constructed in accordance with the present invention.
Figure 10:
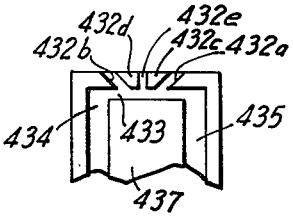
FIG. 10 is a view similar to FIG. 9 and showing still another modified form of the present invention.
Figure 10A:
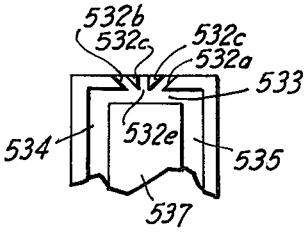
FIG. 10A is a view similar to FIG. 9 showing still another modified form of the present invention.
Figure 11:
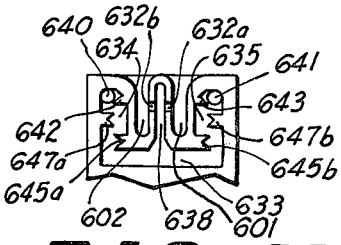
FIG. 11 is a plan view of one side of a flat wafer showing still another embodiment of the present invention.

In FIGS. 9–11, it is shown how the wafer, such as wafer 122 may be modified in numerous ways. For example, the channel or intake port 132 of FIG. 4 may be converted into a pair or a plurality of channels which are angularly disposed with respect to each other. This depicted in FIGS. 9 through 10A.

Referring to FIG. 9, the wafer 122 may be modified so as to provide a pair of inwardly converging channels 232*a* and 232*b* in place of the channel 132. The channels 232*a* and 232*b* are provided in a wafer 222 which is otherwise identical to the wafer 122 so that the channels 232*a* and 232*b* converge towards the central side of the island 237 for directing incoming smoke into the transverse channel 233 which is identical to channel 133. Thence, the divided stream of smoke feeds into the channels 234 and 235 which corresponds to channels 134 and 135 of wafer 122.

In FIG. 10, it is seen that the trapezodial island 232*c* may be bisected, as desired. With such an arrangement, the trapezodial island is divided by an axial channel 432*e* which provides a pair of spaced opposed complementary islands 432*c* and 432*d.* The inwardly converging channels 432*a* and 432*b* are equally spaced on opposite sides of the central channel 432*e*, the three channels 432*a*, 432*b* and 432*e* feeding into the transverse channel 433 and thence in two separate streams to channels 434 and 435. Thence, the channels 434 and 435 correspond to the channels 134 and 135 of wafer 122.

Figure 9A:
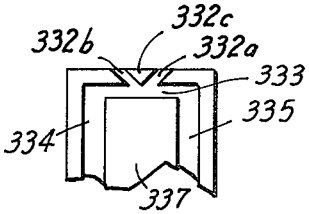
FIG. 9A is a view similar to FIG. 9 and showing still another modified form of the present invention.

As in the embodiments depicted in FIGS. 9 and 9A, the two islands created by the central axial channel, can either be truncated or as two right triangles. In FIG. 10A, the two right triangular islands 532*c* and 532*d* are divided by the central channel 532*e*, their hypothenuses define the inner walls of the inwardly converging channels 532*a* and 532*b*.

As in the preceding embodiment, the channels 532*a*, 532*b* and 532*e* feed into the central portion of the transverse groove 533 and thence to the axial channels 534 and 535. From there on, the channels 534 and 535 correspond to channels 134 and 135, respectively. Numerous other ways of forming channels, passageways, grooves and the like to create a maze in the wafer, such as wafers 122, 222, 322, 422 and 522, are readily devisible. For example, in FIG. 11, still another form of filter is disclosed wherein there is provided a pair of plenum chambers denoted by numerals 601 and 602 into which the smoke passes after passing through the initial filter or grid 114.

In more detail, the wafer 622 depicted in FIG. 11 is identical to wafer 122, except for the forwardmost portion which is illustrated in FIG. 11 and holes 140, 141. The forward portion of wafer 622 is provided with a pair of U-shaped recesses 601, and 602 which are of a depth similar to the depth of the channels and divided by central finger 603. Transverse ports or channels 632*a* and 632*b* in an intermediate portion of the finger 603 lead from opposite side of finger 603 to the central longitudinal channel 638 within the finger 603. The forward end of finger 603 closes the end of the channel 638 while the rear end of the channel is chamfered or flared, immediately prior to its communicating with the central portion of a transverse channel 633.

The ends of channel 633, in turn, communicate with the rear ends of space side channels 634 and 635. The forward ends of channels 634 and 635 communicate with holes 640 and 641, respectively. The holes 640 and 641 correspond to holes 140 and 141 of the wafer 122 except that holes 640, 641 lead to and communicate with the corners forming the junctions of channel 144 with channels 142 and 143. In such an arrangement channels 142, 143 form plenum chambers into which some smoke may circulate. From channel 144, the remainder of the channels through which the smoke passes in wafer 622 are identical to the remaining channels or passageways of wafer 122.

Within the channel 134 and projecting from opposite sides are longitudinally spaced, staggered, bifurcated protrusion 645*a* and 647*a*, the protrusion 645*a* projecting outwardly at the intersection of the passageway 633 and 634 and the protrusion 647*a* protruding inwardly from the opposite sides at an intermediate portion in channel 634. The bifurcated ends of these protrusions are seen in FIG. 11 and include a pair of fingers separated by a v-notch. A somewhat similar protrusion 642 is provided adjacent the hole 640 so that the protrusions 645, 647 and 642 are in opposed offset relationship to each other, the protrusion 642 protruding outwardly as illustrated in FIG. 11. All wafers, including wafer 622, are symmetrical and, therefore, there are the bifurcated protrusions 645*b*, 647*b* and 643 in channel 635 which are complimentary to the protrusions 645*a*, 647*a* and 642.

In the embodiment of FIG. 11, a tortuous path is provided for the smoke in which turbulance is created in the plenum chambers 601 and 602, due to the travel of the smoke from the grid 114 into the chambers. Thence, the smoke passes through the channels 632*a* and 632*b* impinging and intermixing as it is directed down the channels 638, at right angles to the channels 632*a* and 632*b*. The course of the smoke is again altered as the smoke is divided into two paths and travels outwardly along channel 633 and thence forwardly along the parallel channels 634 and 635. The protrusions of these channels, such as protrusions 645*a*, 647*a* and 642 of channel 634, create still additional turbulance causing still additional amounts of solids in the smoke to be thrown out by centrifugal force and the irregular or ragged surfaces of the protrusions capture and retain the particles.

Figure 12:
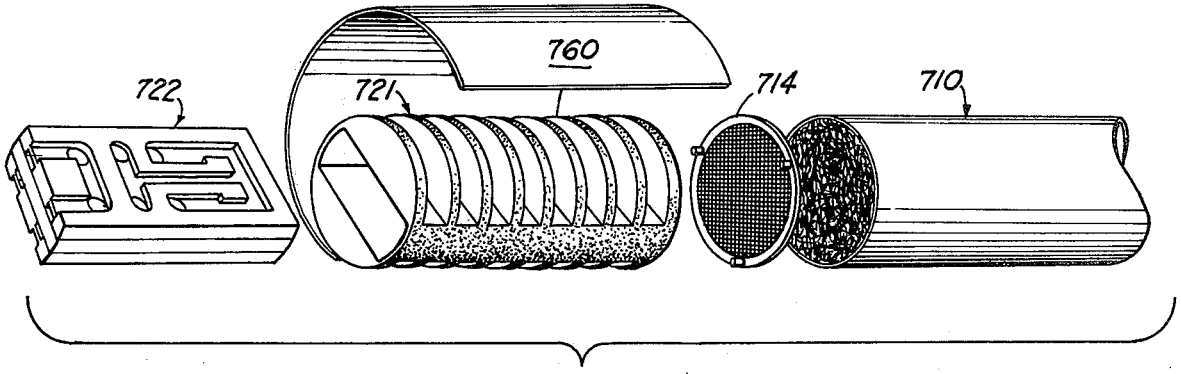
FIG. 12 is a view similar to FIGS. 1 and 4 and showing still another embodiment of the present invention.
Figure 13:
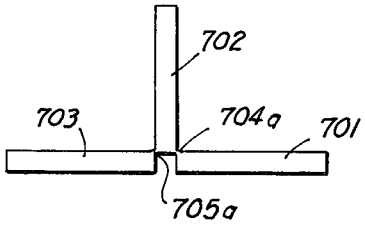
FIG. 13 is a view of the folded out composite wafer of the filter depicted in FIG. 12.
Figure 14:
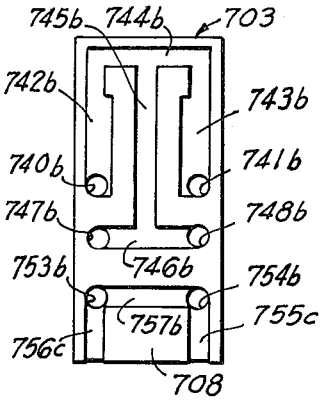
FIGS. 14 through 19 are side elevational views of the sides of the respective wafer elements of the filter cigarette depicted in FIG. 12.
Figure 15:
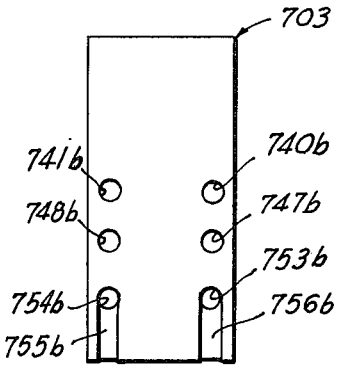
Figure 16:
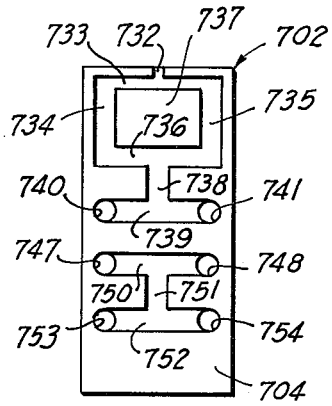
Figure 17:
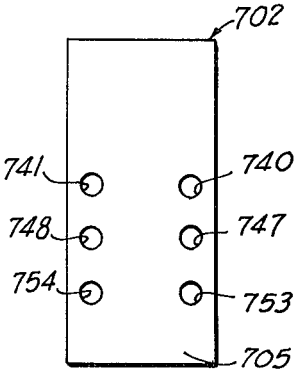
Figure 18:
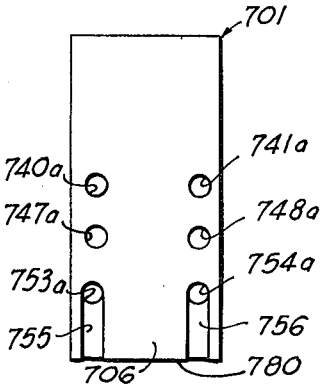
Figure 19:
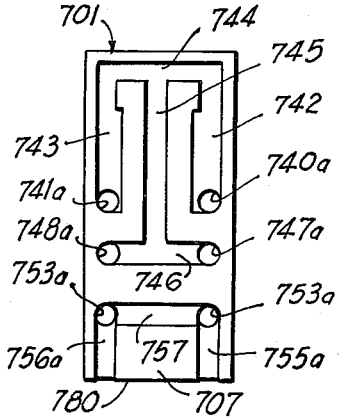
Figure 20:
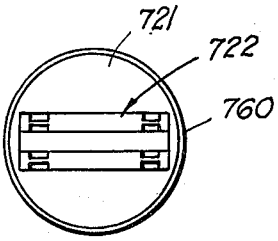
FIG. 20 is an end view of the filter end of the cigarette depicted in FIG. 11.

Referring now to FIGS. 12 and 13, it will be seen that still another embodiment of the present invention includes the laminated wafer denoted generally by numerals 722. This wafer 722 is insertable into the housing 721 which housing is identical in structure to the housing 121. This embodiment is also provided with a paper sheet 760, a grid 714 and forward portion 710 of the cigarette, all identical to the elements 160, 114, and 110 of FIG. 4.

The wafer 722, as seen in FIG. 13, is laminated, being formed of a plurality of wafer layers or elements, respectively, denoted by the numerals 701 and 702 and 703. These wafer elements are hinged along a common side of each other, the wafer element 701 being hinged to wafer element 702 along a common edge by integral hinge 704*a* and the wafer element 703 being hinged to wafer element 702 along a common edge or integral hinge 705*a*.

Figure 5:
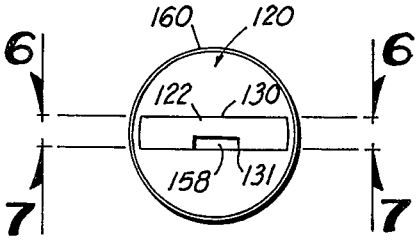
FIG. 5 is an end elevational view of the filtered cigarette depicted in FIG. 4.

The wafer element 702 has channels identical to the channels of surface 130 of wafer 122 as shown in FIG. 5. Thus, the surface 704 of wafer element 702 is provided with an entrance port or channel 732 and the various longitudinal and transverse channels 733, 734, 735, 736, 738, 739, 750, 751, and 752, all identical to the corresponding channels of surface 130 of wafer 122 as shown in FIG. 6. Also, there is an island 737 which is identical to the island 137 of the wafer 122 as shown in FIG. 6. In addition, there are holes 740, 741, 747, 748, 753 and 754 which are identical to the corresponding holes in wafer 122 as shown in FIG. 7.

The other surface 705 of wafer element 702, however, is quite different from the side surface 131 of wafer 122. Thus only the holes 740, 741, 747, 748, 753 and 754 are provided in surface 705. These holes communicate with holes 740*a*, 741*a*, 747*a*, 748*a* 753*a* and 754*a*, respectively, and are in alignment therewith. Surface 706 of wafer 701 is interposed or contiguous with surface 705 of wafer 702. Except for the holes, above described, the surface 706 is flat; however, it is provided with a pair of discharge channels 756 and 757 which lead from the holes 753*a*, 754*a* to the discharge or proximal end 780 of wafer 701. In the other outer side or surface 707 of wafer 701, there is a U-shaped channel which comprises parallel discharge channels 756*a* and 757*a* which disposed parallel to each other, their inner ends being in communication with the holes 753*a* and 754*a* and being connected by a transverse channel 757.

Inwardly of the transverse channel, along surface 707, the holes 747*a* and 748*a* are connected by a transverse channel, 746, the midportion of which communicates with the inner end of a central longitudinal channel 745. The channel 745 terminates at the midportion of a transverse channel 744, the ends of which communicate, respectively, with parallel longitudinal channels 742 and 743 on opposite sides of the central channel 745. The channels 742 and 743 broaden, inwardly, of the ends of channel 744 and terminate at holes 740*a* and 741*a*.

It is, therefore, seen that smoke entering the channel 742 is divided into two channels and passes around the island 737, to be recombined at the central channel 738 and again divided at the transverse channel 739 to be passed through the two opposed holes 740 and 741. Since these holes are in communication with holes 740*a* and 741*a*, respectively, the smoke then passes therethrough and into the channels 742 and 743 where, due to restriction of the channels, the velocity is increased as the smoke is fed from opposite sides through channel 744 into the central channel 745. Thence, the smoke travels to transverse channel 746 and into the holes 747*a* and 748*a*. This directs the smoke through the holes 747 and 748 back to the central wafer 702 where the smoke is fed from opposite sides into channel 751, via 750. Thereafter, the smoke is again divided at channel 752 so as to pass through both holes 753 and 754, as well as holes 753*a* and 754*a* so as to be received in the discharge channels 755, 756 and 755*a*, 756*a* and pass out of the cigarette.

Simultaneously therewith, the smoke which is fed into the channel 739 passes through the holes 740*b* and 741*b* into the parallel channels 742*b* and 743*b*, then into the transverse channel 744*b* and from there through channel 745*b* into channel 746*b* in the surface 708 of wafer elements 703. Thence, the smoke travels through the holes 747*b* and 748*b* into channel 750 and via 751 and 752 into the holes 753*b* and 754*b*. The smoke also travels out of the discharge channels 755*b* and 756*b*, as well as passing out of the channels 755*c* and 756*c*. The holes 754*b* and 753*b* are connected by a transverse channel 757*b*. Since the wafer 701 and 703 are complementary, no more detailed explanation of wafer 703 is deemed necessary. As has been mentioned above, the constant changing of directions in the $x$, $y$ and $z$ coordinates, created centrifugal force which throws out the solids and liquids contained in the smoke, thereby reducing the tar and nicotine entrained in the smoke. The O, H and T shaped passages are particularly suited to this purpose. At the same time, the fact that the channels are relatively open and are not of capillary size, does not hinder the "draw" of the cigarette.

It is now seen that, through the provision in the above described embodiments of O-shaped passages (U-shaped in cross-section), which are connected to the remainder of the passageway from opposite sides (such as the passage defined by channels 133, 134, 135, 136) abrupt changes in the path of travel of the smoke can be accomplished. Also the H-shaped passages (such as the passage defined by channels 148, 147, 152) will cause not only abrupt changes in direction of the smoke but changes in velocity and division and recombining of the flow. T-shaped passages, such as the passage defined by channels 144 and 145, will also accomplish changes in direction and velocity.

Regardless of which embodiment of the filter is employed, the filter is coaxially disposed in tandem with the strainer and the forward position. When utilizing the laminated or contiguous wafers 701, 702, 703, the central wafer 702 is disposed along the longitudinal axis of the cigarette.

The filter of the present invention is particularly useful because of its self regulating features, i.e., the fact that the filter is more efficient at high velocities. For example, it is known that the more vigorously a cigarette is puffed, the greater will be the concentration of nicotine or alkaloid in the smoke. The higher velocity, however, increases the centrifugal action of the filter which compensates by depositing more liquids and solids and their entrained, occluded or dissolved nicotine or alkaloids along the walls of the filter.

The self regulating nature of the embodiments of the present invention is also manifest by the fact that the filter becomes progressively more efficient as the cigarette is smoked. This increase in efficiency is due to the build up of solids and liquids deposited along the interior walls of the filter which serve to trap additional tars and nicotine through adhesion, absorption, or molecular attraction. The unusually long path, of smoke (several times the length of the filter) also permits greater cooling and condensation of vapors and is sufficient for adequate deposit of the thin film of liquid and solids in a non-capillary form over a relatively great area, when compared with prior art filters. This large and unusually long wall area, on which the moisture from the ambient air deposits and which progressively accumulates the thin film of deposited liquids and solids along its surfaces, provides a trap for sulfur dioxides from matches, and a trap for hydrocarbon gases from the burning of the butane lighters and from the burning of cigarette paper.

What is claimed is:

1. In a filtered cigarette of the type wherein tobacco is contained in a sheath in the forward portion of the cigarette, the distal end of which is lighted so that the smoke will be drawn through the tobacco and the proximal end of the cigarette into the rear portion of the cigarette by the person smoking the cigarette, the combination therewith of a filter in the rear portion of said cigarette, said filter being characterized by:

a. a flat wafer core having a passageway leading from the distal end of said core to its proximal end along the surface of said flat wafer core with said passageway including a maze of individual outwardly opening channels recessed along one surface of said flat wafer core arranged so as to split the smoke into diverging streams and so as to recombine the split smoke streams into a single stream; and b. a cover for closing outwardly and outwardly opening channels.

2. The filtered cigarette defined in claim 1 wherein said wafer is a rigid wafer and said channels are disposed in opposite surfaces of said wafer and wherein said passageway includes holes through said wafer and communicates with ends of the channels in both surfaces for providing a path for said smoke from one side of said wafer to the other and passageways for directing the smoke in opposite directions transverse to the distal-proximal direction.

3. The filtered cigarette defined in claim 1 in which said channels include transversely and longitudinally extending U-shaped outwardly open channels communicating with each other.

4. The filtered cigarette defined in claim 1 wherein said cover is a cylindrical plastic housing having a housing which receives the wafer within the housing.

5. The filtered cigarette defined in claim 4 wherein said cover has spaced radial fins radiating from said housing.

6. In a filtered cigarette of the type wherein tobacco is contained in a sheath in the forward portion of the cigarette, the distal end of which is lighted so that the smoke will be drawn through the tobacco and the proximal end of the cigarette into the rear portion of the cigarette by the person smoking the cigarette, the combination therewith of a filter in the rear portion of said cigarette, said filter being characterized by:

a. a core having a passageway leading from the distal end of said core to its proximal end along the surface of said core with said passageway opening outwardly of said surface, and wherein said core is formed from a plurality of contiguous flat wafers each of which are provided with a portion of said passageway and wherein certain of said wafers are provided with channels recessed in a surface, the channel being closed at its outer portion by a surface of the next adjacent wafer; and b. a cover for closing the open portions of said passageway.

7. The filtered cigarette defined in claim 6 wherein adjacent (of said) wafers are hingedly secured together along common edges.

* * * * *